US005381828A

United States Patent [19]

Kimura et al.

[11] Patent Number: 5,381,828

[45] Date of Patent: Jan. 17, 1995

[54] SLOW STARTING VALVE

[75] Inventors: Yasuhisa Kimura; Takehiko Miyaguchi, both of Ibaraki, Japan

[73] Assignee: SMC Kabushiki Kaisha, Tokyo, Japan

[21] Appl. No.: 861,381

[22] Filed: Mar. 31, 1992

[30] Foreign Application Priority Data

Apr. 9, 1991 [JP] Japan ..... 3-76582

[51] Int. Cl.[6] ..... F15B 13/043

[52] U.S. Cl. ..... 137/596; 91/443; 91/447; 137/599

[58] Field of Search ..... 91/29, 31, 446, 443, 91/447; 137/110, 599, 596

[56] References Cited

U.S. PATENT DOCUMENTS

Re. 30,403 9/1980 Bitonti ..... 91/29

4,596,271 6/1986 Brundage ..... 137/540

FOREIGN PATENT DOCUMENTS 0097246 1/1984 European Pat. Off. .

2582749 12/1986 France .

*Primary Examiner*—Gerald A. Michalsky

*Attorney, Agent, or Firm*—Oblon, Spivak, McClelland, Maier, & Neustadt

[57] ABSTRACT

A valve for slowly starting an actuator includes a block having an inlet port, an outlet port, and a passage providing communication between the inlet and outlet ports. A first valve body is disposed in the passage for selectively opening and closing the passage, and a second valve body is disposed downstream of the first valve body with respect to the passage for selectively opening and closing the passage. A needle valve is disposed in the block parallel to the second valve body between the passage and the outlet port for restricting the fluid under pressure discharged from the outlet port. The second valve body has a passage defined therein and communicating from one end to the other end thereof, and first and second pressure-bearing surfaces on the one and other ends, respectively, the first pressure-bearing surface is wider than the second pressure-bearing surface.

5 Claims, 5 Drawing Sheets

SLOW STARTING VALVE

BACKGROUND OF THE INVENTION

1. Field of the Invention

The present invention relates to a valve for gradually supplying a fluid under pressure to an actuator to slowly start the actuator, and more particularly to a slow starting valve for holding a fluid under pressure for a predetermined period of time with a needle valve when a valve body is opened by a solenoid-operated valve, to start an actuator at low speed.

2. Field of the Invention

There have heretofore been widely used actuators which are reciprocally operated when supplied with a fluid under pressure upon opening and closing operation of a solenoid-operated valve. If the power supply for the solenoid-operated valve fails while the actuator is in operation or the power supply is restored after the actuator is shut off in case of emergency, then the actuator may not be controlled properly and may operate in error because of a fluid under pressure that remains in the actuator, a fluid supply passage, or a fluid discharge passage.

To solve the above problems, there has been employed a slow starting valve 2 as shown in FIG. 1 of the accompanying drawings. The slow starting valve 2 comprises a block 10 having an inlet port 4, an outlet port 6, and a discharge port 8 which are defined therein, a first valve body 14 disposed in a passage 12 which provides communication between the inlet port 4 and the outlet port 6, and a second valve body 16 disposed in the body 10.

The first valve body 14 has a smaller-diameter lower valve member 18 for closing the passage 12. The second valve body 16 has a valve member 20 for preventing communication between a chamber 32 in the block 10 and the discharge port 8. The valve members 18, 20 are normally urged to move upwardly in FIG. 1 by respective springs 22, 24. The valve members 18, 20 are normally seated on respective valve seats 26, 28.

A needle valve 30 is disposed in the block 10 below the inlet port 4. The needle valve 30 has a pointed distal end facing a passage 34 communicating with the chamber 32 that is defined between the first and second valve bodies 14, 16. A passage 36 is defined in the block 10 and extends from the inlet port 4 across a manually movable spool valve 38 to a valve body 42 of a solenoid-operated valve 40.

The spool valve 38 is housed in a chamber 44 from which a passage 46 extends to a valve member 48 of the second valve body 16. A passage 50 which also extends from the valve 44 goes to the valve body 42 of the solenoid-operated valve 40. The first valve body 14 also has a larger-diameter valve member 52 housed in a chamber that is vented to the atmosphere through a passage 54. The valve member 52 has a pressure-bearing surface communicating with the outlet port 6 through a passage 56.

When the solenoid-operated valve 40 is inactivated and the spool valve 38 is in the position shown in FIG. 1, a fluid under pressure introduced from the inlet port 4 flows through the passage 34 across the needle valve 30 into the chamber 32. Since the valve members 18, 20 in the chamber 32 are seated on the respective valve seats 26, 28, the fluid pressure does not flow out of the outlet port 6.

When the solenoid-operated valve 40 is actuated, the valve body 42 is opened, allowing the fluid under pressure introduced from the inlet port 4 to flow through the passage 36 across the spool valve 38 into the passage 50, and then from the chamber 44 through the passage 46, thereby displacing the valve member 48 of the second valve body 16 downwardly in FIG. 1. As a result, the valve member 20 of the second valve body 16 is unseated from the valve seat 28, so that the fluid under pressure introduced from the inlet port 4 flows through the passage 34 and the chamber 32 into the outlet port 6, from which the fluid under pressure is gradually supplied to an actuator (not shown) connected to the outlet port 6.

The pressure of the fluid that flows into the outlet port 6 is applied through the passage 56 to the valve member 52 of the first valve body 14. In the case where the coil spring 22 has a sufficiently large resilient force, the fluid pressure supplied via the needle valve 30 and applied to the valve member 18 and the resilient force of the coil spring 22 are large enough to overcome the pressure from the larger-diameter valve member 52, and hence the first valve body 14 is not opened. Since the amount of the fluid flowing through the needle valve 30 to the outlet port 6 is very small, the amount of the fluid supplied to the actuator is also very small, making it possible to start the actuator gradually, i.e., slowly.

When the fluid pressure applied to the valve member 52 is gradually increased, the first valve body 14 is lowered in FIG. 1 while overcoming the fluid pressure acting on the valve member 18 and the resilient force of the coil spring 22. The fluid under pressure introduced from the inlet port 4 is therefore supplied directly to the outlet port 6.

When the fluid under pressure flows after the first valve body 14 is displaced downwardly, an appreciable pressure drop is developed, lowering the fluid pressure in the outlet port 6. As a result, the fluid pressure in the passage 56 drops, and the first valve body 14 is displaced upwardly under the fluid pressure acting on the valve member 18 and the resilient force of the coil spring 22, blocking the fluid pressure from the inlet port 4. Consequently, the first valve body 14 is closed after only a large amount of fluid under pressure is consumed. The actuator still operates slowly, and the pressure drop may cause erroneous operation of the pilot-operated valve.

The above drawback may be eliminated by increasing the area of the pressure-bearing surface of the valve member 52 of the valve body 14. However, the increased area of the pressure-bearing surface of the valve member 52 may cause the valve body 14 to open too early, and the actuator which has been started slowly may tend to operate quickly before it reaches the stroke end.

With the above arrangement, unless the area of the pressure-bearing surface of the valve member 52 is considerably increased, the valve body 14 cannot be displaced downwardly against the valve member 18 which is urged upwardly by the fluid pressure introduced from the inlet port 4 and the resilient force of the coil spring 22 because the primary fluid pressure from the inlet port 4 is applied to the lower surface of the larger-diameter valve member 52 and the fluid pressure lower than the primary fluid pressure is applied to the upper pressure-bearing surface of the valve member 52. Accordingly, the conventional slow starting valve shown in FIG. 1 is necessarily large in size.

SUMMARY OF THE INVENTION

It is an object of the present invention to provide a slow starting valve which holds a valve body open through positive utilization of a static pressure developed by the flow of a fluid under pressure for avoiding erroneous operation without being affected by a secondary fluid pressure, is relatively small in size, and largely cuts down the amount of a fluid under pressure consumed for displacing the valve body.

According to the present invention, there is provided a slow starting valve comprising a block, the block having an inlet port defined therein for introducing a fluid under pressure, an outlet port defined therein for discharging a fluid under pressure, and a passage providing communication between the inlet and outlet ports, a first valve body disposed in the passage for selectively opening and closing the passage, a second valve body disposed downstream of the first valve body with respect to the passage for selectively opening and closing the passage, and a needle valve disposed parallel to said second valve body between said passage and outlet port for restricting the fluid under pressure discharged from the outlet port, the second valve body having a passage defined therein and communicating from one end to the other end thereof, and first and second pressure-bearing surfaces on the one and other ends, respectively, the first pressure-bearing surface is wider than the second pressure-bearing surface.

The first pressure-bearing surface is substantially twice as wide as the second pressure-bearing surface.

The flow starting valve further includes a resilient member acting on the second pressure-bearing surface for normally urging the second valve body in a direction to seat the first pressure-bearing surface.

The flow starting valve further includes a check valve disposed parallel to said second valve body between said passage and outlet port the check valve being closable to supply the fluid under pressure from the inlet port to the needle valve when the slow starting valve starts to operate.

The check valve is opened to supply the fluid under pressure from the inlet port in bypassing relationship to the needle valve when the first pressure-bearing surface of the second valve is unseated to open the passage.

The first pressure-bearing surface of the second valve is hemispherical in shape.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
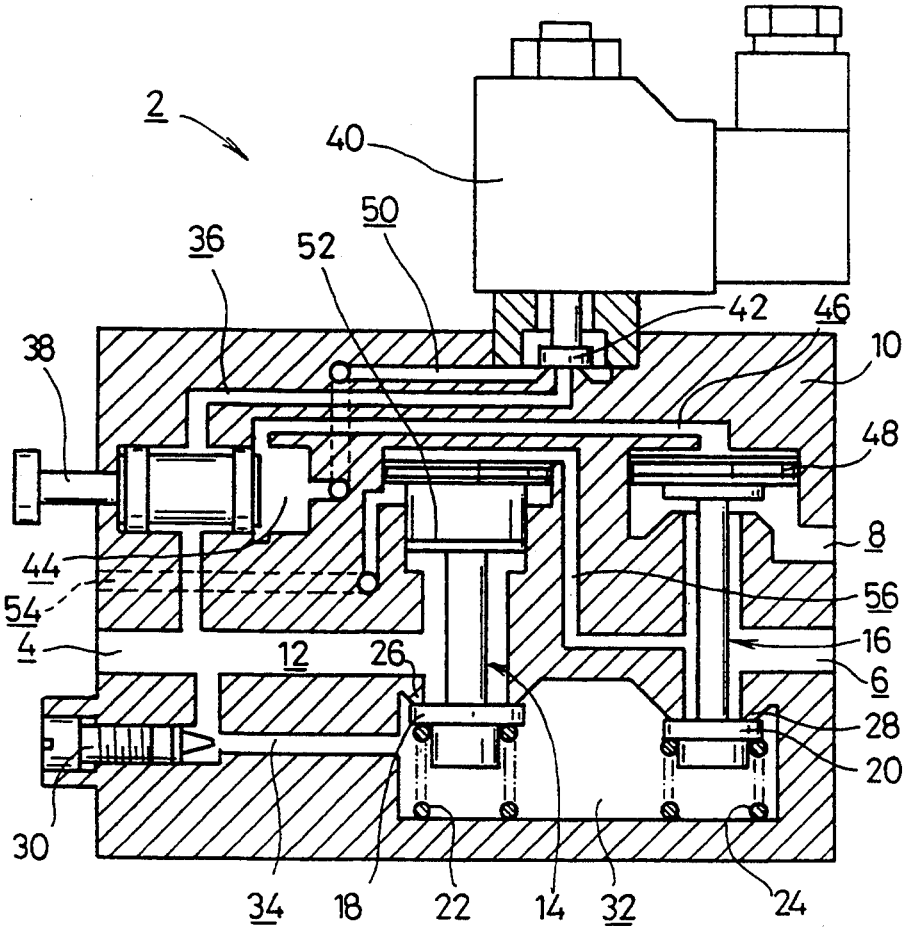
FIG. 1 (PRIOR ART)
FIG. 1 is a vertical cross-sectional view of a conventional slow starting valve.
Figure 2:
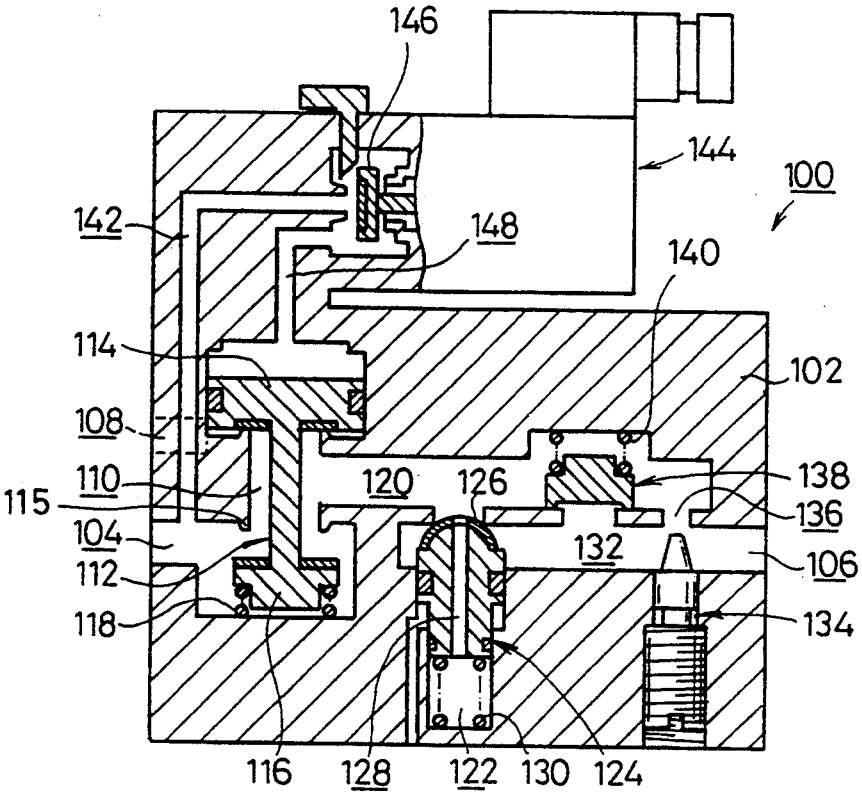
FIG. 2 is a vertical cross-sectional view of a slow starting valve according to an embodiment of the present invention, the view being illustrative of the manner in which a fluid under pressure operates when a solenoid-operated valve is actuated.
Figure 3:
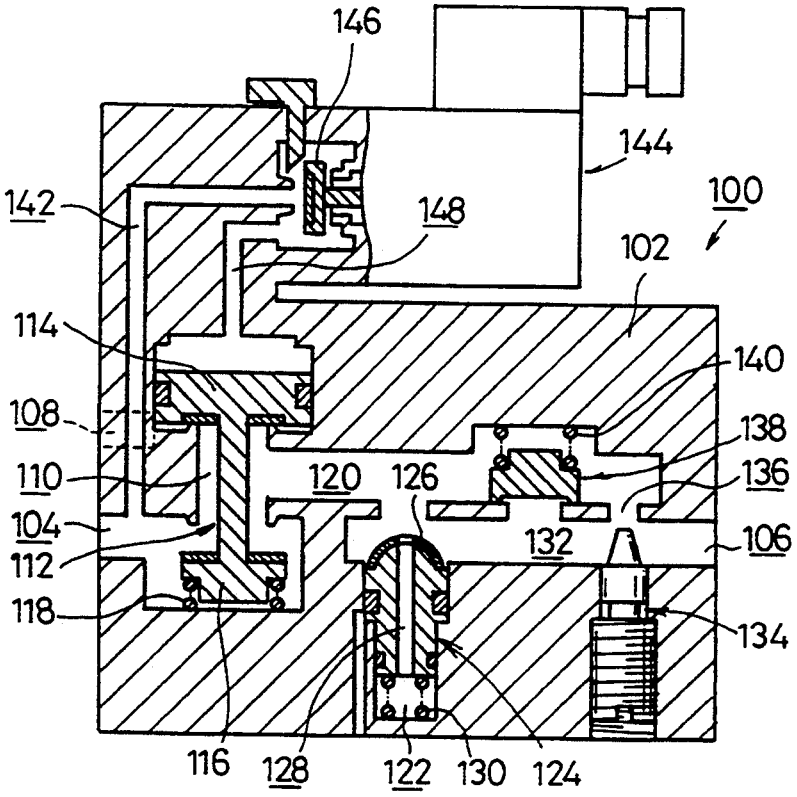
FIG. 3 is a view similar to FIG. 2, showing the manner in which a fluid under pressure operates when a second valve body is displaced.

FIGS. 2 and 3 schematically show a slow starting valve according to an embodiment of the present invention.

The slow starting valve, generally designated by the reference numeral 100, comprises a block 102 having an inlet port 104, an outlet port 106, a discharge port 108 defined therein. The block 102 also has a chamber 110 defined therein near the inlet port 104 and the discharge port 108 with a first valve body 112 disposed in the chamber 110. The first valve body 112 has a larger-diameter valve member 114 on its upper end and a smaller-diameter valve member 116 on its lower end. A coil spring 118 acts on the valve member 116 for normally urging the first valve body 112 to move upwardly in FIGS. 2 and 3.

The chamber 110 communicates with a chamber 122 defined in the block 100 through a passage 120, and the chamber 122 houses a second valve body 124 therein. The second valve body 124 has a hemispherical valve member 126 on its upper end and a slender passage 128 defined along the axis of the second valve body 124 and extending downwardly into the chamber 122. The second valve body 124 is normally urged to move upwardly by a coil spring 130 disposed in the chamber 122. The chamber 122 communicates through a passage 132 with the outlet port 106. A needle valve 134 is disposed in the block 102 and has an axis normal to the direction in which the passage 132 extends. The needle valve 134 has a pointed distal end extending into a slender passage 136 defined in the block 102.

A check valve 138 is disposed in the passage 120 and is normally urged by a coil spring 140 in a direction to prevent direct communication between the passage 120 and the passage 132. The inlet port 104 communicates with a passage 142 defined in the block 100, which can be closed by a valve body 146 of a solenoid-operated valve 144. A passage 148 defined in the block 100 opens toward the valve body 146 and serves to apply a fluid pressure to the valve member 114 of the first valve body 112.

The slow starting valve according to the above embodiment operates and offers advantages as follows:

When the valve body 146 of the solenoid-operated valve 144 closes the passage 142, a fluid under pressure introduced from the inlet port 104 acts upwardly on the valve member 116 of the first valve body 112. Under the fluid pressure thus applied to the valve member 116 and also the resilient force of the coil spring 118, the valve member 116 is displaced upwardly and seated on a valve seat 115. Therefore, the fluid pressure is not supplied from the outlet port 106 to an actuator (not shown) connected to the outlet port 106.

When the solenoid-operated valve 144 is actuated to unseat the valve body 146 from its seat as shown in FIG. 2, the fluid pressure introduced from the inlet port 104 through the passage 142 pushes and displaces the valve member 114 of the first valve body 112 downwardly. Specifically, the fluid pressure applied to the pressure-bearing surface of the valve member 114 which is larger than the pressure-bearing surface of the valve member 116 is effective to lower the first valve body 112 against the bias of the coil spring 118, as shown in FIG. 2. The fluid under pressure from the inlet port 104 now flows through the chamber 110 and the passage 120 past the check valve 138 into the passage 136. The fluid under pressure is restricted by the needle valve 134 and then discharged from the outlet port 106. The fluid under pressure discharged from the outlet port 106 is supplied to the actuator to gradually drive the actuator.

Inasmuch as the fluid under pressure is restricted by the needle valve 134, the fluid pressure in the passages 132, 120 gradually builds up and acts on the second valve body 124. The hemispherical valve member 126 on the upper end of the second valve body 124 defines a semispherical pressure-bearing surface which is subjected to a fluid pressure buildup in the passages 132, 120. Therefore, the second valve body 124 is displaced downwardly in its entirety. Specifically, as shown in FIG. 3, the fluid pressure buildup in the passages 132, 120 which acts on the hemispherical pressure-bearing surface of the hemispherical valve member 126 is large enough to overcome the bias of the coil spring 130 and the pressure-bearing surface of the lower end of the second valve body 124, with the result that the second valve body 124 is lowered. At this time, the fluid under pressure from the passage 120 is supplied through the passage 132 and the outlet port 106 to the actuator. Further, as readily understood by referring to FIGS. 2 and 3, when the first valve body 112 is raised to block flow between the inlet port 104 and the passage 120, the discharge port 108 is thereby put in communication with the passage 120. Because the passage 120 is opened to atmosphere via the discharge port 108, the pressure in the passage 132 becomes relatively larger than the pressure in the passage 120. This pressure difference in passages 120 and 132 will cause the check valve 138 to open so as to allow any fluid under pressure in the region of the outlet port 106 to be rapidly exhausted in by passing relationship to the needle valve 134.

The hemispherical pressure-bearing surface of the valve body 126 is about twice as wide as the pressure-bearing surface of the lower end of the second valve body 124, and the primary fluid pressure is supplied to the lower end of the second valve body 124 through the passage 128. Consequently, when the fluid pressure acting on the valve body 126 overcomes the bias of the coil spring 130 due to the difference between the areas of the pressure-bearing surfaces of the valve body 126 and the lower end of the second valve body 124, the second valve body 124 is displaced downwardly. The passages 120, 132 are now brought into direct communication with each other. The amount of a fluid under pressure which is consumed by the slow starting valve is relatively small.

Figure 4:
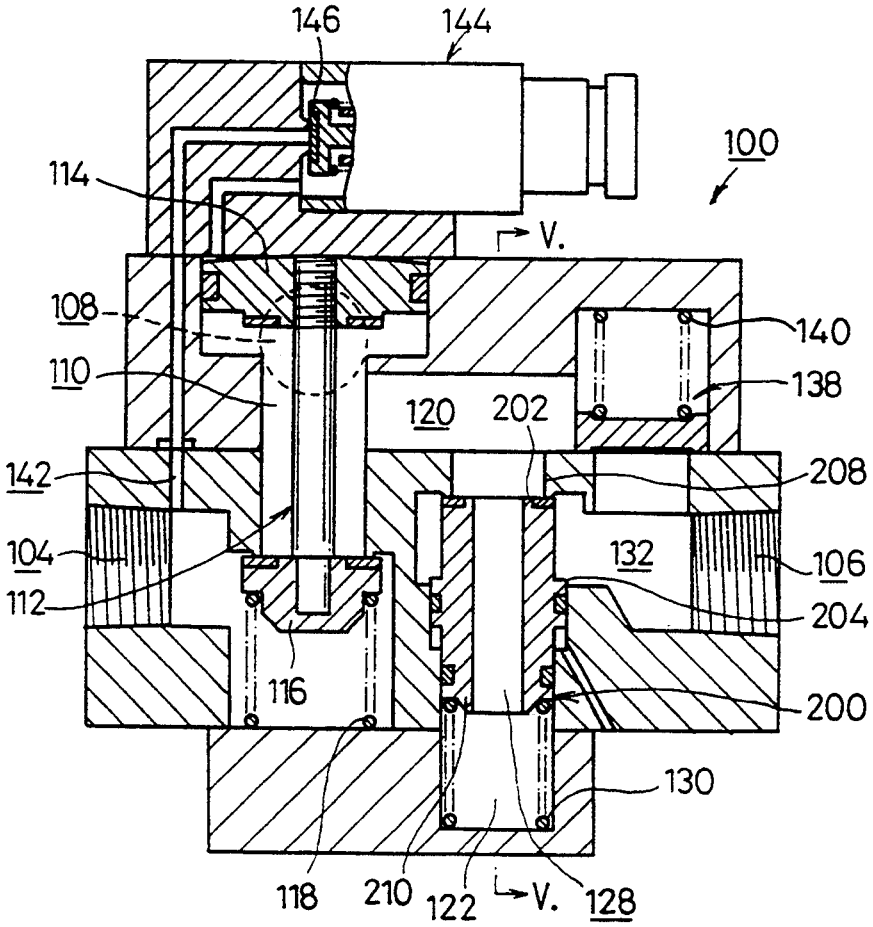
FIG. 4 is a vertical cross-sectional view of a slow starting valve according to another embodiment of the present invention.
Figure 5:
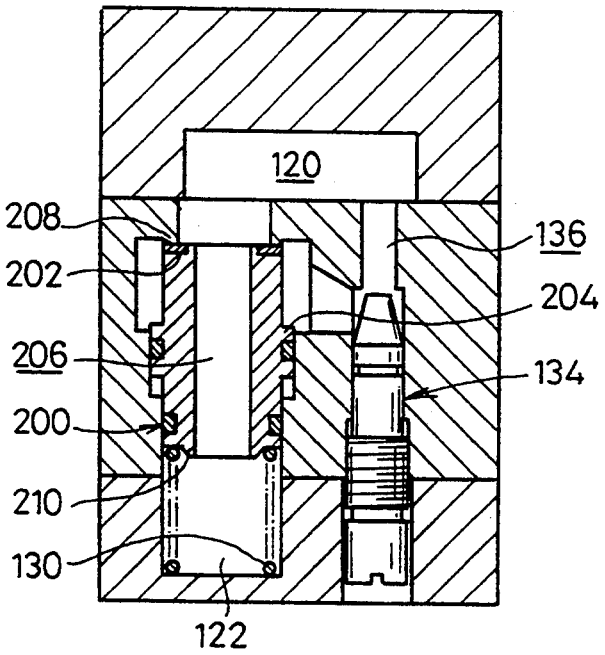
FIG. 5 is a cross-sectional view taken along line V—V of FIG. 4.

FIGS. 4 and 5 show a slow starting valve according to another embodiment of the present invention. Those parts shown in FIGS. 4 and 5 which are identical to those shown in FIGS. 2 and 3 are denoted by identical reference numerals, and will not be described in detail below.

The slow starting valve shown in FIGS. 4 and 5 has a valve body 200 corresponding to the second valve body 124 shown in FIGS. 2 and 3. The valve body 200 has a pressure-bearing surface 202 on its upper end, a pressure-bearing flange 204 on its central portion, and a pressure-bearing surface 210 on its lower end. The valve body 200 has a passage 206 defined therein along its axis. The valve body 200 is normally urged to seat on an upper valve seat 208 under the bias of a coil spring 130. The upper pressure-bearing surface 202 and the lower pressure-bearing surface 210 have respective areas at a ratio of 2:1. The pressure-bearing flange 204 is twice as wide as the lower pressure-bearing surface 210. Therefore, as the fluid pressure in the chamber 110 and the passage 120 is increased by being restricted by the needle valve 134, the fluid pressure acting on the pressure-bearing surface 202 lowers the valve body 200 at a certain time. Once the pressure-bearing surface 202 is unseated off the valve seat 208, the passage 120 is brought into communication with the passage 132, with the result that the fluid pressure also acts on the flange 204. Therefore, the fluid pressure applied to the pressure-bearing surface 202 and the pressure-bearing flange 204 quickly displaces the valve body 200 downwardly, allowing the fluid under pressure to flow from the passages 120, 132 into the outlet port 106.

When the solenoid-operated valve 144 is inactivated, the valve body 146 closes the passage 142. As a consequence, since no fluid pressure is applied to the valve body 114, the valve body 112 moves upwardly under the bias of the coil spring 118 and fluid pressure acting upwardly to the second valve body 116 until the second valve body 116 is seated whereupon the second valve body 116 cuts off the communication between the inlet port 104 and the chamber 110. As a result, the pressure of the fluid gradually flowing via the needle valve 134 into the outlet port 106 is reduced on the pressure-bearing surface 202, which moves upwardly and is finally seated on the valve seat 208 under the bias of the coil spring 130 and the fluid pressure acting on the pressure-bearing surface 210. Therefore, the direct communication between the passages 120, 132 is now cut off. Therefore, the supply of the fluid under pressure to the actuator is stopped.

With the present invention, the actuator can gradually be started by the slow starting valve which is of a highly simple structure. The actuator is reliably prevented from operating erroneously, operates safely, and is not abruptly displaced when returned to the original position upon removal of the fluid pressure. The slow starting valve may be relatively small in size, and consumes a minimum amount of fluid under pressure.

Although certain preferred embodiments of the present invention have been shown and described in detail, it should be understood that various changes and modifications may be made therein without departing from the scope of the appended claims.

What is claimed is:

1. A slow starting valve comprising:

a block;

said block having an inlet port defined therein for introducing a fluid under pressure, an outlet port defined therein for discharging a fluid under pressure, and a passage providing communication between said inlet and outlet ports;

a first valve body disposed in said passage for selectively opening and closing said passage;

a second valve body disposed downstream of said first valve body with respect to said passage for selectively opening and closing said passage;

a needle valve disposed parallel to said second valve body between said passage and said outlet port for restricting the fluid under pressure discharged from said outlet port;

said second valve body having a passage defined therein and communicating from one end to the other end thereof, and first and second pressure-bearing surfaces on said one and other ends, respectively, said first pressure-bearing surface is wider than said second pressure-bearing surface; and a check valve disposed parallel to said needle valve between said passage and said outlet port, said check valve being closeable to supply the fluid under pressure from said inlet port to said needle valve when the slow starting valve starts to operate;

wherein said first valve body, said second valve body, said needle valve and said check valve are provided in parallel and are all movable in the same direction.

2. A slow starting valve according to claim 1, wherein said first pressure-bearing surface is substantially twice as wide as said second pressure-bearing surface.

3. A slow starting valve according to claim 2, further including a resilient member acting on said second pressure-bearing surface for normally urging said second valve body in a direction to seat said first pressure-bearing surface.

4. A slow starting valve according to claim 2, wherein said first pressure-bearing surface of the second valve is hemispherical in shape.

5. A slow starting valve according to claim 1, wherein said check valve is opened to exhaust the fluid under pressure from said outlet port in bypassing relationship to said needle valve when the first valve body blocks the passage between the inlet port and the outlet port and opens the passage between the outlet port and a discharge port.

* * * * *